US005810655A

United States Patent [19]

Suzukawa et al.

[11] Patent Number: 5,810,655

[45] Date of Patent: Sep. 22, 1998

[54] COIN CONVEYING DEVICE

[75] Inventors: Yorio Suzukawa; Yoshiaki Mizuta, both of Saitama, Japan

[73] Assignee: Asahi Seiko Kabushiki Kaisha, Tokyo, Japan

[21] Appl. No.: 606,301

[22] Filed: Feb. 23, 1996

[30] Foreign Application Priority Data

Feb. 23, 1995 [JP] Japan ..... 7-074374

[51] Int. Cl.[6] ..... G07D 1/00

[52] U.S. Cl. ..... 453/50; 221/252; 221/267

[58] Field of Search ..... 453/7, 11, 31–35, 453/50, 56, 57; 194/346; 221/252, 267

[56] References Cited

U.S. PATENT DOCUMENTS 1,795,287 3/1931 Bottome ..... 194/346 X 3,351,075 11/1967 Weisskopf ..... 453/32 X 4,518,001 5/1985 Branham ..... 221/267 X

FOREIGN PATENT DOCUMENTS 687989 2/1940 Germany ..... 194/346

53-115298 10/1978 Japan ..... 194/346

*Primary Examiner*—F. J. Bartuska

*Attorney, Agent, or Firm*—Sughrue, Mion, Zinn, Macpeak & Seas, PLLC

[57] ABSTRACT

In a coin conveying device, a second coin outlet is provided nearby a first coin outlet and an outlet switching mechanism is provided between the first and second coin outlets so that coins can be ejected from either of the coin outlets selected by the outlet switching mechanism.

21 Claims, 8 Drawing Sheets

COIN CONVEYING DEVICE

BACKGROUND OF THE INVENTION

1. Field of the Invention

This invention relates to a coin conveying device connected to a coin feeding device for conveying coins and, more concretely, to a coin conveying device connected to a coin feeding device incorporated in vending machines as well as exchange machines or all kinds of game machines.

2. Related Background Art

U.S. Pat. No. 4,518,001 discloses a coin conveying device known, for example, as one of conventional coin conveying devices. In this device, a coin passage is formed such that right and left side plates are put between a front face plate and a back face plate, one side plate having a coin outlet opened to the outside. During operation, coins fed by a coin feeding device from a lower end of the coin passage are forced to be ejected outside from the coin outlet formed at the upper end thereof by an ejector provided within the coin passage.

Such a coin conveying device is often required to change the coin ejecting direction depending upon internal configuration of a vending machine or the like in which the device is built, or upon the mounting position of the coin feeding device on which the coin conveying device is mounted. In other words, there is a case that the coins are ejected from either the right side or the left side taking a front view of the coin conveying device due to a limitation in internal configuration of the machine or the like.

The coin conveying device, however, has only one coin outlet opened on one side plate (in case of the above patent publication, on the right side of the device). For this reason, in order to provide a device capable of ejecting coins from the left side of the device, there is a need to manufacture front, back, right side and left side plates of the device for left ejection in a different manner than the existing device.

This causes bad economy due to an increase in number of parts. It is also inconvenient for workers to take great care during assembly which device they must assemble; left ejecting type or right ejecting type. Further, a user of the device may desire to change the ejecting direction after the device was delivered, but such a requirement can not be satisfied.

An object of the present invention is to dissolve the above problems, that is, to provide a coin conveying device having a single part or ejecting mechanism the coin ejecting direction of which can be easily changed even after delivery, resulting in cost-efficiency and the convenience of assembly with no need to manufacture different parts such as right side and left side parts for satisfying a requirement of two-way ejection.

SUMMARY OF THE INVENTION

The inventor has happened to think of using a single part in common for two-way ejection such as in right and left directions and designed the coin conveying device as follows:

In a coin conveying device (1) having a passage plate (2) and a coin passage (3) formed along the passage plate (2) for conveying coins (C) fed by a coin feeding means (30) into a coin inlet (8) of the coin passage (3) and ejecting them from a first coin outlet (10) provided above (or in a higher position than) the coin inlet (8), a second coin outlet (11) nearby the first coin outlet (10) is provided in the coin passage (3), and outlet switching means (12) is provided between the first coin outlet (10) and the second coin outlet (11), such that the coin (C) is guided to either the first coin outlet (10) or the second coin outlet (11) owing to the outlet switching means (12).

In other words, the coins fed from the coin inlet by the coin feeding means are lifted up through the inside of the coin passage toward the coin outlets and then ejected from either the first coin outlet or the second coin outlet due to the selection by the coin switching means.

The term of "coin feeding means" in the specification indicates means for feeding coins from the coin inlet into the coin passage, so that every kind of means can be used as long as it can act such a function. For example, such means are disclosed in Japanese Patent Publication Nos. 62-45588 and 63-36040 to the present applicant.

In the coin conveying device (1) as previously described, there is a coin guide means (13) is provided so that the outlet switching means (12) can be attached to and removed from the passage plate (2) for guiding the coins (C) to the first coin outlet (10) when the coin guide means (13) is held in a second holding position (24) on the passage plate (2) and to the second coin outlet (11) when it is held in a first holding position (23).

In other words, the use of the coin guide means as switching means allows the device to guide the coin to the first coin passage when the guide means is held in the second holding position on the passage plate and to the second coin passage when it is held in the first holding position. Accordingly, the coins can be guided in two different directions by use with a single part.

In the coin conveying device (1) there is also a coupling path (22) is provided on the passage plate (2) for communicating the first holding position (23) with the second holding position (24) so that the coin guide means (13) can be moved between the first holding position (23) and the second holding position (24) just as it was attached to the passage plate (2).

In other words, the use of the coupling path allows the coin guide means to move between the first holding position and the second holding position along the coupling path just as it was attached to the passage plate, whereby the switching means is forced to switch the coin ejecting direction. Accordingly, the ejecting direction can be switched without removing the coin guide means from the passage plate.

In the coin conveying device (1) a first holding position (23) is provided in a first guide path (14) and the second holding position (24) is provided in a second guide path (15), in which the coin guide means (13) is moved either from the second holding position (24) along the second guide path (15) due to feeding of the coin (C) so that the second coin outlet (11) can be closed, or from the first holding position (23) along the first guide path (14) due to feeding of the coin (C) so that the first coin outlet (10) can be closed.

In other words, the use of the first and second guide paths allows the coin guide means to be moved due to the feeding of the coin from the second holding position along the second guide path so that the second coin outlet can be closed. When switching the switching means, the coin guide means is moved due to the feeding of the coin from the first holding position along the first guide path so that the first coin outlet can be closed. If the switching means is switched again, then the coin guide means is returned to the former position. This makes it possible to eject the coins either from the first coin outlet that is not closed in the former case, or from the second coin outlet that is not closed in the latter case.

In the coin conveying device (1) the coin guide means (13) moved due to feeding of the coin (C) returns to the original position by its own weight after the coin (C) passes through.

In this case, the coin guide means returns to the original position by its own weight, i.e., under gravitation and waits for the subsequent coin.

In the coin conveying device (1) recovery means (17) is provided for returning the coin guide means (13) to the original position by compulsion.

In other words, the use of the recovery means allows the coin guide means to wait for the subsequent coin in the original position to which the coin guide means is forced by the recovery means to return.

In the coin conveying device (1) the recovery means (17) is a weight provided in the coin guide means (13) or a spring for making the coin guide means (13) elastic.

In the coin conveying device (1) the first holding position (23) is provided in a first guide path (14), the second holding position (24) is provided in a second guide path (15), the coin guide means (13) is moved either from the second holding position (24) along the second guide path (15) due to feeding of the coin (C) so that the second coin outlet (11) can be closed, or from the first holding position (23) along the first guide path (14) due to feeding of the coin (C) so that the first coin outlet (10) can be closed, and recovery means (17) is provided for returning the coin guide means (13) to the original position by compulsion after the coins pass through, such that the coins are compulsively ejected from one of the coin outlets when the coin guide means (13) is returned to the original position under the action of the recovery means.

In the coin conveying device (1) the recovery means (17) may be a weight or a spring.

In the coin conveying device (1) the coin guide means (13) comprises a rotary roller in contact with the edge of the coin (C) and a roller shaft (19) supporting the rotary roller in which the roller shaft (19) is guided along the first guide path (14) or the second guide path (15).

When the rotary roller is used as coin guide means, the rotary roller guides the coins to either of the coin outlets while contacting with the edge of the coin, the roller shaft supporting the rotary roller being guided along the first or second guide path.

Further, when an inclined plane is provided around the rotary roller, the coin in contact with the inclined plane is pushed against the passage plate by a reaction of a component force on the inclined plane, thus preventing the coin from getting out of the passage.

The passage constituted of the first and second guide paths and coupling path can take a substantially reverse V-shape so as to move the coin guide means through the inside of the passage.

In the coin conveying device (1), an inclined plane (13*a*) is provided around the rotary roller (13) for pushing the coin (C) against the passage plate (2) when contacting with the edge of the coin (C).

In the coin conveying device (1), the passage constituted of the first guide path (14), the second guide path (15) and the coupling path (22) substantially takes any one of shapes; reverse V-shape, reverse U-shape, H-shape or downward channel shape.

BRIEF DESCRIPTION OF THE DRAWINGS

By way of example and to make the description more clear, reference is made to the accompanying drawings in which.

BEST MODE FOR CARRYING OUT THE INVENTION

First embodiment

Figure 1:
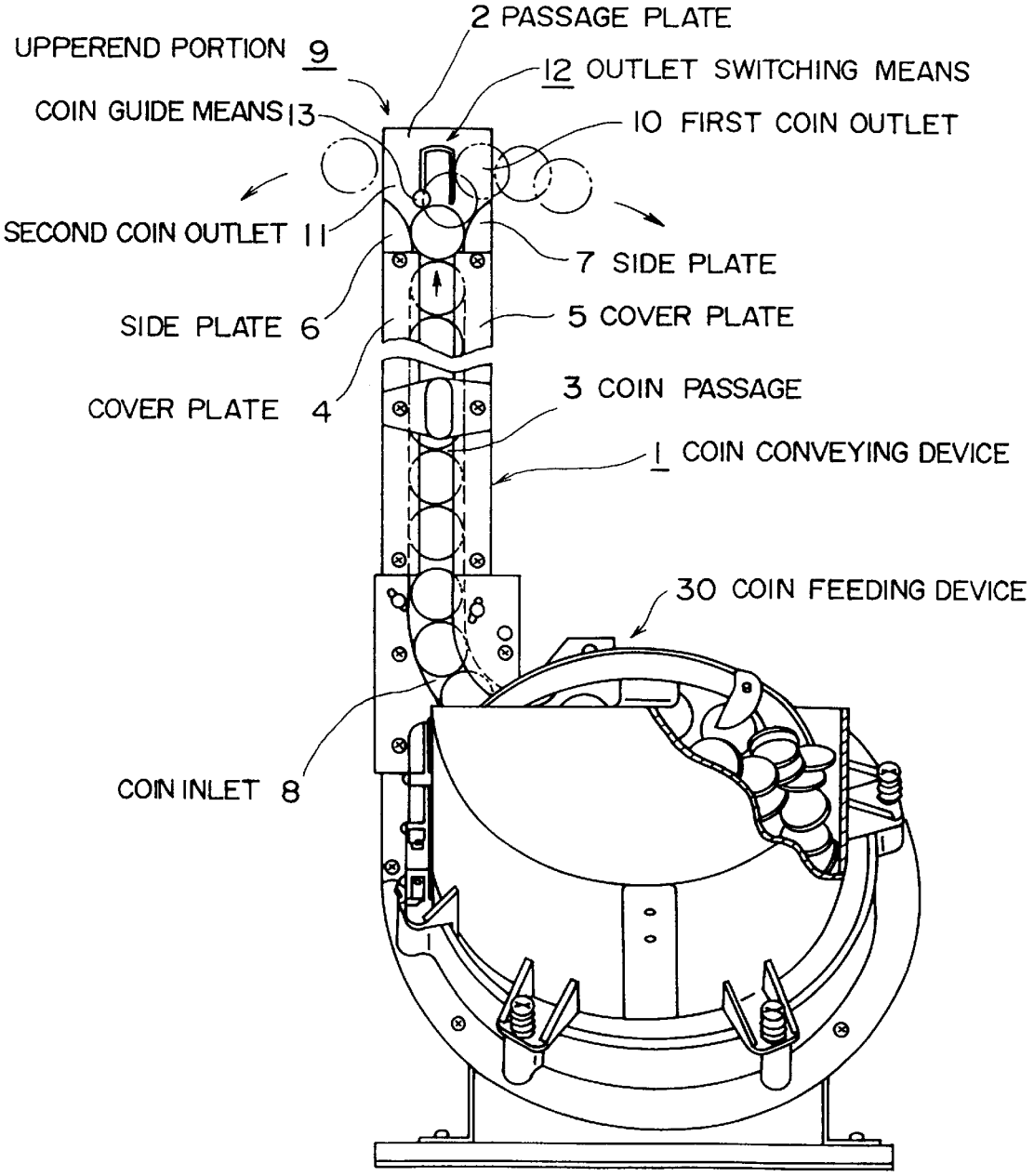
FIG. 1 is a front view showing a coin conveying device according to a first embodiment which is attached to a coin feeding device.
Figure 2:
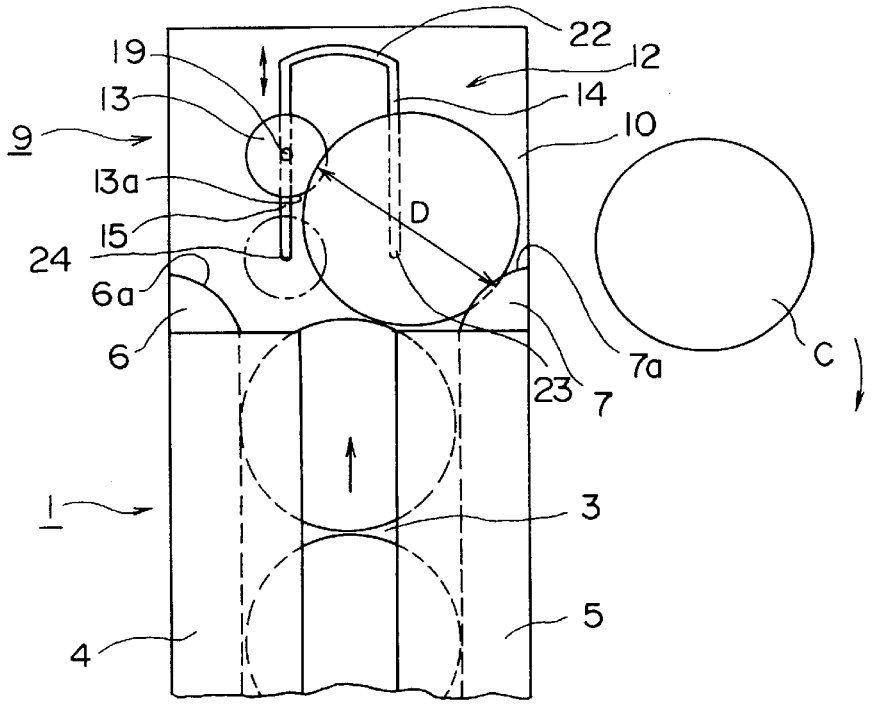
FIG. 2 is a partially enlarged view of the coin conveying device according to the first embodiment.
Figure 3:
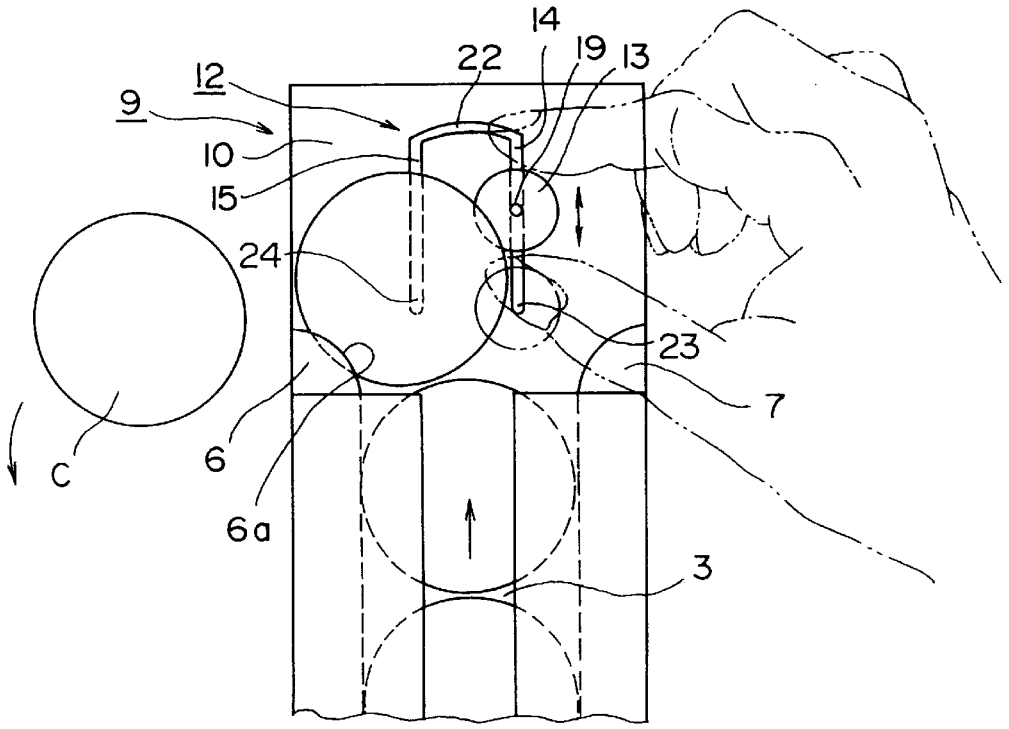
FIG. 3 is a partially enlarged view of the coin conveying device according to the first embodiment.

A description will be made with respect to the first embodiment of the present invention with reference to FIGS. 1 to 3. FIG. 1 is a front view of a coin conveying device 1 mounted on a coin feeding means 30. FIG. 2 and FIG. 3 are partially enlarged views of the coin conveying device 1 according to the first embodiment.

As shown in FIG. 1, the coin conveying device 1 mainly includes a passage plate 2 and a coin passage 3 formed of cover plates 4 and 5 disposed opposite to the passage plate 2 through side plates 6 and 7. The coin passage 3 is sized such that coins C which are fed by the coin feeding device from a coin inlet 8 provided at a lower end of the coin passage 3 can be carried in a row. An upper end portion 9, which is formed by extending the passage plate 2 to the outside of the coin passage 3, is then provided at the upper end of the coin passage 3.

Provided in the upper end portion 9 are, as shown in FIGS. 2 and 3, a first coin outlet 10 (on the right standing before the drawings), a second coin outlet 11 (on the left standing before the drawings) and outlet switching means 12 between the first coin outlet 10 and the second coin outlet 11. The outlet switching means 12 includes coin guide means 13 which can be used preferably as a moving member guided along a first guide path 14 and a second guide path as described below.

The hand motion illustrated by a two-dotted chain line or virtual line in FIG. 3 will be described later with a description of the outlet switching means 12.

The coin guide means 13, as shown in FIGS. 1 to 3, is operative to guide the coin C to the coin outlet selected by contacting with the edge of the coin C. The coin guide means 13 is not restricted in form, but preferably is formed with a rotary roller in order to reduce contacting friction with the coin C. Also, the rotary roller 13 is not restricted in shape, but preferably has an inclined plane 13*a* on a surface contacting with the coin C as described below.

In addition, "coin guide means" is generically referred to as "a rotary roller" in the specification to ease the understanding.

Figure 6:
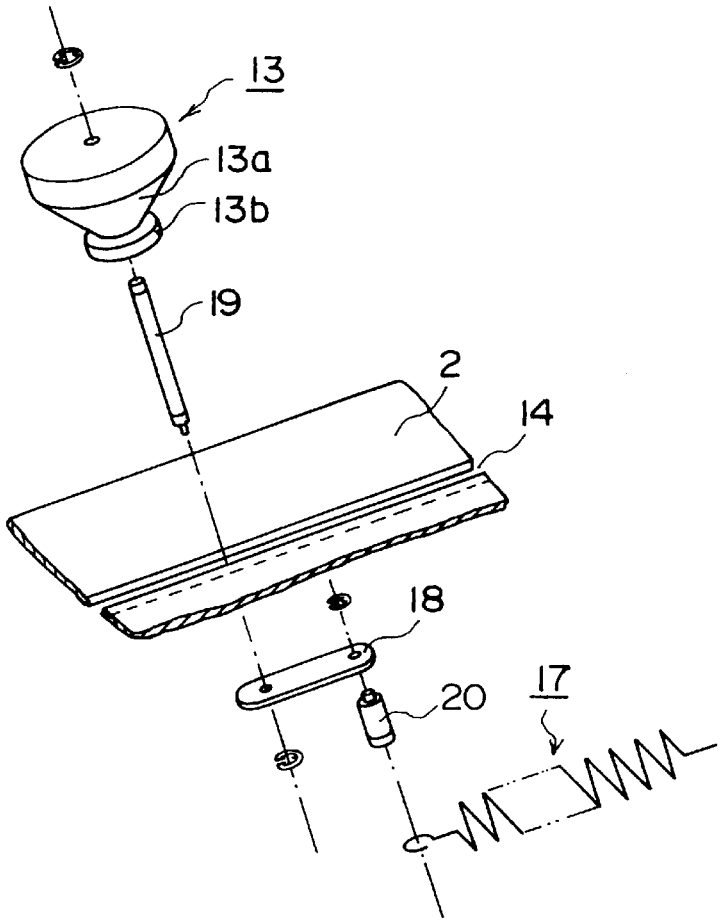
FIG. 6 is a schematic perspective showing a state of a rotary roller attached to a first guide path provided in a passage plate.
Figure 7:
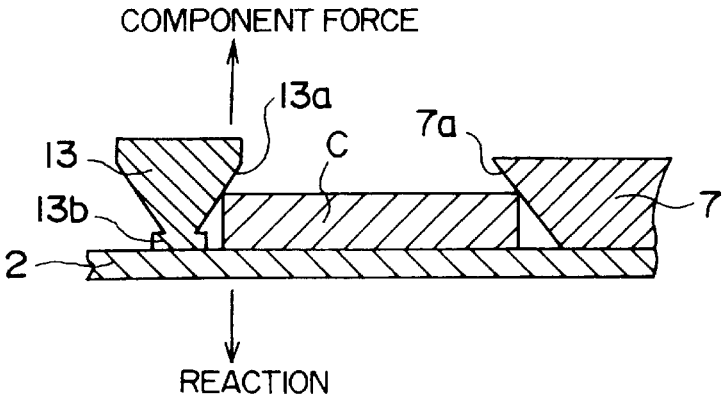
FIG. 7 is a schematic view of a cross section taken on line B—B of FIG. 4 as seen from the direction of arrows.

Referring next to FIGS. 6 and 7, the rotary roller will be described. FIG. 6 shows a state that the rotary roller 13 is attached to the first guide path provided on the passage plate 2. FIG. 7 is a schematic view of a cross section taken on line B—B of FIG. 4 as seen from the direction of arrows. The rotary roller 13 has an inclined plane 13*a* contacting with the coin and a boss 13*b* contacting with the passage plate 2, and forms its cross section into a coffee cup or the like as shown in FIG. 7. The rotary roller 13 is then supported so that it can be rotated around a roller shaft 19 as shown in FIG. 6.

The inclined plane 13*a,* as shown in FIG. 7, is operative to push the coin against the surface of the passage plate 2 by a reaction (the downward allow of FIG. 7) of a force (the upward allow of FIG. 7) which is one of forces applied when the coin contacts with the rotary roller 13 and which attempts to separate the rotary roller 13 from the surface of the passage plate 2. It should be noted that an inclined edge 7*a* shown in FIG. 7 is provided around the side plate 7 and is operative to push the coin against the surface of the passage plate 2 in the same manner as the inclined plane 13*a*. An inclined edge 6*a* is also provided around the side plate 6 for the same operation.

Turning back to FIGS. 2 and 3, a description will be made with respect to the first guide path 14 (on the right standing before the drawings) and the second guide path 15 (on the left standing before the drawings). Both the guide paths operative to guide the rotary roller 13 contacting with the coin as discussed above can guide the coin C to one coin outlet selected to eject the coin by means of the rotary roller 13, the other coin outlet not selected being closed.

The first guide path 14 and the second guide path 15 are each extended in a direction and given a length so as to give effect to such coin ejection and passage closing. In the first embodiment, though the guide paths are formed substantially in parallel to each other, other forms can be taken in consideration of a relationship among the size of the coin C, an ejecting angle of the coin C, shapes of the side plate 7 and the surface 7*a* contacting with the coin, etc.

For example, the guide paths can take a V-shape each, or different shapes each corresponding to a diameter of the coin C when the coin C ejected from the first coin outlet 10 differs in diameter from that ejected from the second coin outlet 11. Further, a distance D between the contacting surface 7*a* of the side plate 7 and the inclined plane 13*a* of the rotary roller 13 with which the coin contacts is determined to be larger than the maximum diameter of the ejected coin so that the coin C can move the rotary roller 13.

Next, a description will be made with respect to the outlet switching means 12 based upon FIGS. 2 and 3. The outlet switching means 12 is operative to switch the ejecting direction of the coin ejected from the coin conveying device 1. In the embodiment, the outlet switching means 12 is constituted of a coupling path 22 for not only coupling the rotary roller 13 with the first and second guide paths 14 and 15, but also coupling the first guide path 14 with the second guide path 15. In other words, the rotary roller 13 held at a lower end (second holding position) 24 of the second path 15 as shown in FIG. 2 can be moved to a lower end (first holding position) 23 of the first path 14 through the coupling path 22 as shown in FIG. 3 without removing the rotary roller 13 from the passage plate 2. Thus, the outlet for ejecting the coin can be switched from the first coin outlet 10 to the second coin outlet 11.

The coupling path 22 is not restricted in form as long as the first guide path 14 and the second guide path 15 are coupled through the coupling path 22 so that the rotary roller 13 can be moved therebetween and, for example, the above three paths can substantially take any one of shapes; reverse U-shape, reverse V-shape, H-shape or downward channel shape.

Operation of first embodiment

Next, a description will be made with respect to the operation of the first embodiment with reference to FIGS. 2 and 3. At first, a case that the first coin outlet 10 is selected will be described. As shown in FIG. 1, the coins C, which are fed by the coin feeding means 30 from the coin inlet 8 of the coin conveying device 1, are carried upwardly through the inside of the coin passage 3. At this time, the coin located at the uppermost end contacts with the rotary roller 13 (virtual line) kept in the second holding position shown in FIG. 2.

The inclined plane 13*a* of the rotary roller 13 and the inclined edge 7*a* of the side plate 7 cooperate in the upper end portion 9 to push up the rotary roller while pushing the coin C against the surface of the passage plate 2. The rotary roller 13 is then moved upwardly along the second guide path 15 to a position as indicated by a solid line. At this time, the rotary roller 13 is operative to guide the coin C to the first coin outlet 10 while closing the second coin outlet 11 to prevent ejecting the coin C therefrom.

After ejecting the coin, the rotary roller 13 is returned to the original position or the second holding position 24 along the second guide path 15 by its own weight or under gravitation and waits for the subsequent coin C.

When the coin outlet is switched by the outlet switching means 12, the operation is as follows: the rotary roller 13 held in the second holding position 24 on the second guide path 15 is picked by hand as illustrated by the virtual line of FIG. 3 to move it through the coupling path 22 to the first holding position 23 on the first guide path 14.

Accordingly, even if the second coin outlet 11 is selected, the rotary roller 13 has the same operation and advantages when the first coin outlet 10 is selected. In this case, as shown in FIG. 3, the rotary roller 13 is moved along the first guide path 4 to eject the coin C from the second coin outlet 11, and then it is returned to the second holding position (as indicated by the virtual line) by its own weight to wait for the subsequent coin C.

Advantages of first embodiment

The coin outlet can be easily switched by merely transferring the holding position of the guide roller 13 of the outlet switching means 12 between the first guide path 14 and the second guide path 15 without replacing any part. Accordingly, a device capable of two-way ejection with a single part can be obtained by merely manufacturing the coin conveying device 1 having such a switching mechanism 12 therein, and this results in cost-efficiency and the convenience of device assembly. Further, the present invention has the advantage of enabling the coin conveying device to change its coin ejecting direction easily even after delivery.

Furthermore, the inclined plane 13*a* and the inclined edge 7*a* cooperate with each other in preventing the coin from dropping off the upper end portion 9. For this reason, the upper end portion 9 can be kept open, and this makes it possible to prevent the coin from getting stuck in the upper end portion 9 as well as to ease cleaning of the upper end portion 9.

Second embodiment

Figure 4:
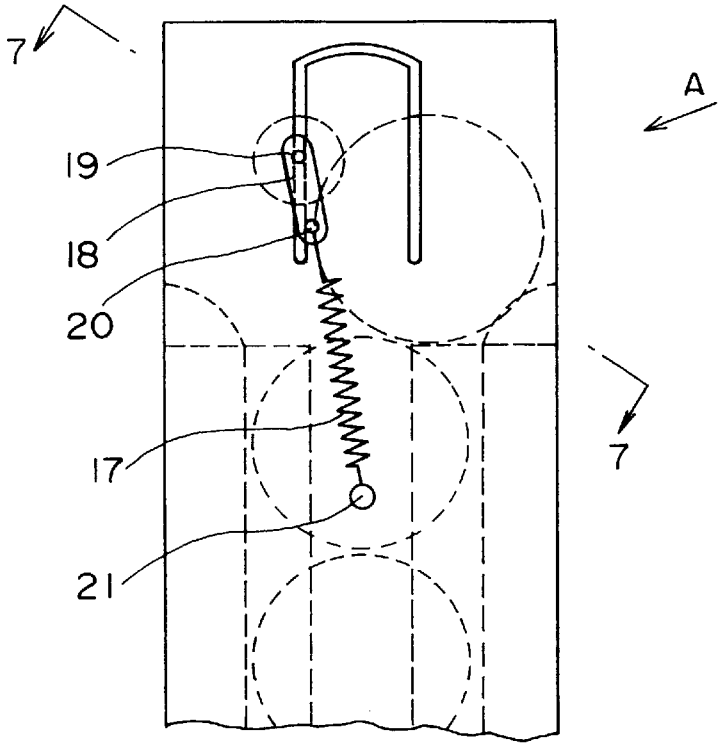
FIG. 4 is a schematic view showing a state of a coin conveying device according to a second embodiment as seen from the back side.
Figure 5:
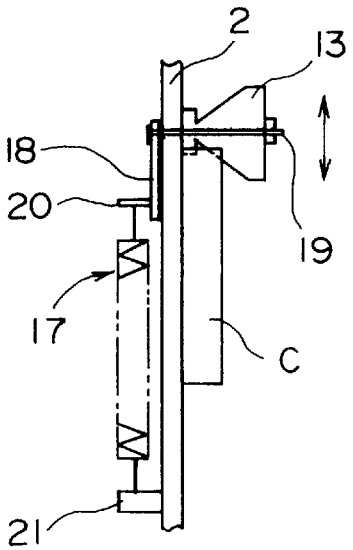
FIG. 5 is a schematic view of the coin conveying device shown in FIGS. 3 and 4 as seen from a direction of arrow A.

In the second embodiment, recovery means 17 is provided in the coin conveying device 1 of the first embodiment as shown in FIGS. 4 to 7. FIG. 4 is a schematic view showing the coin conveying device 1 of FIG. 3 as seen from the back side. FIG. 5 is a schematic view showing the coin conveying device 1 of FIG. 4 as seen from a direction of arrow A. FIG. 6 is a view showing a state that the rotary roller 13 is attached to the first guide path provided on the passage plate 2. FIG. 7 is a schematic view of a cross section taken on line B—B of FIG. 4 as seen from the direction of arrows. In FIGS. 4 to 7, the same parts as those in the first embodiment use the same reference numerals as in the first embodiment.

In the second embodiment, the recovery means 17 is provided for returning the rotary roller 13 by compulsion as shown in FIG. 4 in order to shorten the recovery time for obtaining high-speed coin ejection. The recovery means 17, one end of which is fixed by a pin 21 to the passage plate 2 opposite to the coin passage 3 and the other end of which is attached to a roller shaft 19 through a moving plate 18, is a coil spring as shown in FIG. 4. The moving plate 18 is movable while contacting with the passage plate 2.

The roller shaft 19 is attached rotatably to a stop hole provided at one end of the moving plate 18 through the first guide path 14 provided on the passage plate 2 as shown in FIG. 6. On the other hand, a fitting pin 20 is attached rotatably to a stop hole provided at the other end of the moving plate 18, one end of the coil spring 17 fixed to a tip of the fitting pin 20. The fixed pin 21 is then attached to the other end of the coil spring 17 as shown in FIG. 4.

While the coil spring is used as recovery means 17 in the second embodiment, any other mechanism may be employed as long as it can return the rotary roller 13 to the original position and it is not restricted in direction of the recovery force on the rotary roller 13. In other words, there can be used as recovery means a spring other than the coil spring or a mechanism (e.g., plate spring) capable of storing energy due to a change in shape such as length, or an elastic member such as rubber or synthetic resin capable of storing energy due to a change in volume. Further, while the recovery means acts in such a direction as the rotary roller 13 is pulled down, it may act in such a direction as the rotary roller 13 is pushed down.

The number of springs may be not only one but also two or more without any limitation in its attaching position. Furthermore, a weight may be provided in the rotary roller 13 so that the rotary roller 13 can be returned compulsively to the original position by the weight.

Operation of second embodiment

The second embodiment has the same operation as the first embodiment, but is different in provision of recovery means 17 from the first embodiment.

That is, the coin pushes up the rotary roller 13 against a pull-up force of the coil spring 17 so that the rotary roller 13 pushed up can guide the coin C to the coin outlet 11, and then the rotary roller 13 is compulsively returned to the original position due to the pull-up force.

Advantages of second embodiment

In addition to the advantages in the first embodiment, the second embodiment allows the rotary roller 13 to return to the original position with a higher speed than by its own weight because the recovery is made by compulsion. This makes it possible to deal with the subsequent coins quickly, and higher ejecting efficiency can be obtained.

Further, plural kinds of coins the size of which is different from each other can be ejected since the rotary roller 13 is movable along the guide paths. In other words, coin ejection can be done with no effect on the ejecting operation occurring by merely changing a moving distance of the rotary roller 13 based upon a difference in size between coins when two sized coins, a certain sized coin and larger (smaller) sized coin, are required.

Third embodiment

In the third embodiment, the recovery means 17 comprises a powerful member compared with that of the second embodiment. In other words, the recovery means 17 used in the second embodiment is not required to have a powerful recovering force as long as it can return the rotary roller 13 to the original position by compulsion.

However, there is a case the coin is required to be ejected apart from the coin outlet in a predetermined range due to a requirement or limitation resulting from an internal configuration of the vending machine in which the coin conveying device 1 is incorporated. In order to satisfy such a requirement, the third embodiment uses a member the recovering force of which is made strong instead of the recovery means 17 used in the second embodiment. That is, the recovery means 17 according to the third embodiment comprises rubber or an elastic member the elasticity of which is strengthened.

Operation and advantages of third embodiment

Essentially, the third embodiment has the same operation and advantages as the second embodiment, but is different therefrom as follows: the coin C is shot out from the coin outlet under the influence of the strengthened recovery means 17 returning the rotary roller 13, and this allows the coin C to be ejected apart from the coin outlet in a predetermined range.

Fourth embodiment

Figure 8:
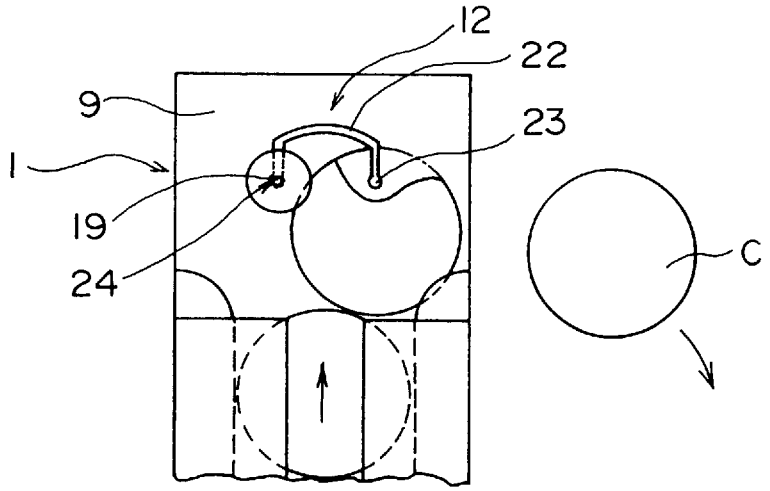
FIG. 8 is a partially enlarged view of a coin conveying device according to a fourth embodiment.
Figure 9:
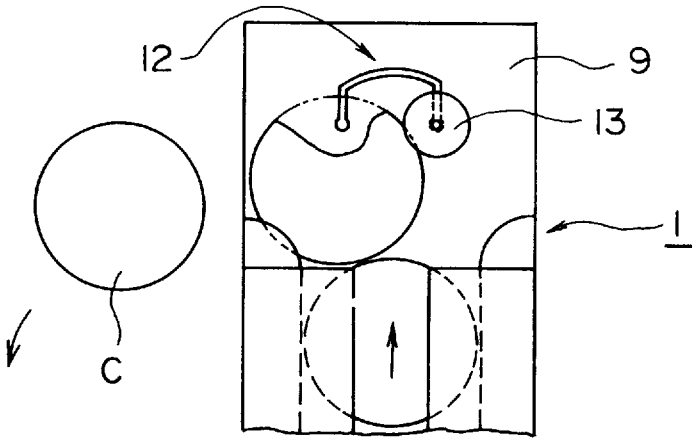
FIG. 9 is a partially enlarged view of another coin conveying device according to the fourth embodiment.
Figure 10:
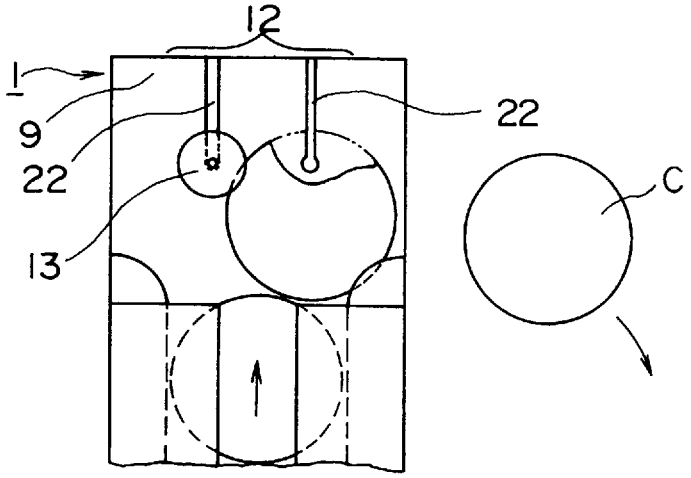
FIG. 10 is a partially enlarged view of still another coin conveying device according to the fourth embodiment.

Next, a description will be made with respect to the fourth embodiment with reference to FIGS. 8 to 10. The same parts as in the first to third embodiments use the same reference numerals. FIGS. 8 to 10 are plan views each showing the upper end portion 9 of the coin conveying device 1. FIG. 8 shows a coin ejecting state in which the coin C is ejected from the first coin outlet 10; FIG. 9 shows a coin ejecting state in which the coin C is ejected from the second coin outlet 11; and FIG. 10 shows a modification of FIGS. 8 and 9. The device shown in FIG. 9 has the same structure as that of FIG. 8 and exhibits the same operation and advantages, so that the repeated description will be avoided.

The upper end portion 9 of the coin conveying device 1 shown in FIG. 8 includes the outlet switching means 12 in which the first and second holding positions 23 and 24 are provided for supporting the rotary roller 13. During operation, the coin is guided to the first coin outlet 10 when the rotary roller 13 is supported in the second holding position 24, whereas it is guided to the second coin outlet 11 when the rotary roller 13 is supported in the first holding position 23. The roller shaft 19 supporting the rotary roller 13 then penetrates a supporting hole provided on the passage plate 2 and is fixed to the passage plate 2 with a fly screw (not shown) from the back side thereof. Thus, the rotary roller 13 is fixed to and supported by the passage plate 2.

In the embodiment, a screw is used as fixing and support means as mentioned above, but any other mechanism can be adopted as long as it can fix and support the rotary roller 13, i.e., it can attach and remove the rotary roller 13 to and from the passage plate 2.

The coupling path 22 is also provided in the upper end portion 9 for communicating the first holding position 23 with the second holding position 24. The coupling path 22 holds the rotary roller 13 movably, and this makes it possible to switch the holding position of the rotary roller 13.

The coupling path 22 is not restricted in form as long as it can achieve such operation and, for example, it may take a reverse U-shape shown in FIG. 8 as well as a reverse V-shape, a straight line coupling both holding positions, and a form shown in FIG. 10 in which the coupling path 22 is open from the edge of the upper end portion 9.

Operation and advantages of fourth embodiment

The use of the coin conveying device according to the fourth embodiment results in easy switching of coin ejecting direction which is achieved by loosening the fly screw so that the rotary roller 13 can be moved from one holding position to the other holding position and then tightening it again.

Fifth embodiment

Figure 11:
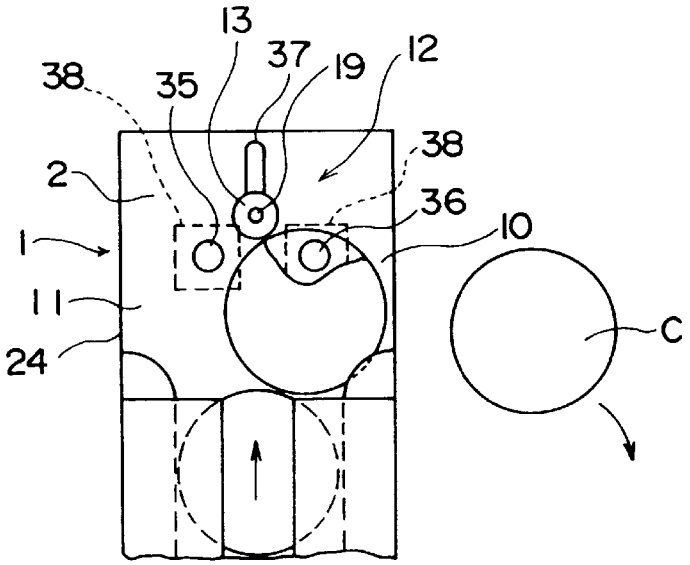
FIG. 11 is a partially enlarged view of a coin conveying device according to a fifth embodiment.
Figure 12:
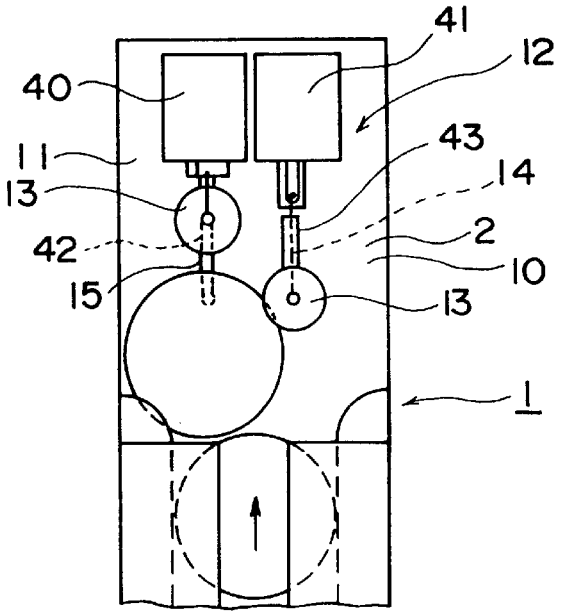
FIG. 12 is a partially enlarged view of another coin conveying device according to the fifth embodiment.
Figure 13:
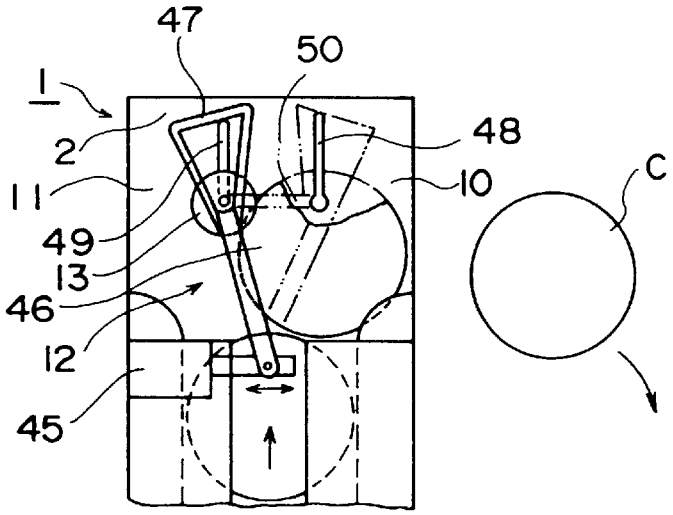
FIG. 13 is a partially enlarged view of still another coin conveying device according to the fifth embodiment.

Referring next to FIGS. 11 to 13, a description will be made with respect to the fifth embodiment. The same parts as those of the first to fourth embodiments use the same reference numerals. FIGS. 11 to 13 are plan views each showing the upper end portion 9 of the coin conveying device 1.

The fifth embodiment is to control the outlet switching means 12 making use of solenoids as shown in such drawings.

Firstly, a description will be made based upon FIG. 11. Indicated by reference numerals 35 and 36 are coin guide pins for guiding the coin C by contact with it. The coin guide pins 35 and 36 are controlled by solenoids 38 and 39 mounted on the back side of the passage plate 2 so that one pin can be drawn back when the other pin is projecting from the surface of the passage plate 2. In other words, the coin guide pin 35 is pushed out and the coin guide pin 36 is drawn back when the coin is to be ejected from the first coin outlet 10. If the coin is to be ejected from the second coin outlet 11, the relative motion between the pins is reversed.

In the embodiment, a guide path 37 is provided in the middle of the passage plate 2 so that the coin guide means or the rotary roller 13 can be moved up and down along the guide path 37. The rotary roller 13 is attached rotatably to the roller shaft 19 so as to move around the shaft and is forced downwardly by recovery means (not shown) as is similar to the other embodiments. This embodiment has the same operation and advantages as described in the other embodiments and the repeated description will be avoided.

Next, a description will be made based upon FIG. 12. This embodiment is a modification of the first embodiment, in which the coin outlet is switched by turning on either a first solenoid 40 or second solenoid 41. In other words, the rotary roller 13 is pulled up against the recovery means (not shown) by turning on the first solenoid 40 as shown in FIG. 12 when the coin is to be ejected from the second coin outlet 11, whereas the operation is reversed when the coin is to be ejected from the first coin outlet 10. Thus, the coin can be ejected from either of the coin outlets.

Each plunger of the solenoids and each rotary roller is combined by a coupling pin so that the rotary roller 13 can be moved up and down along either the first guide path 14 or the second guide path 15 when the solenoid is turned off, i.e., when the plunger is not drawn. The other operation and advantages are the same as those of the other embodiments and the description will be omitted.

Next, a description will be made based upon FIG. 13. This embodiment is a modification of the first embodiment, in which the coin outlet is switched by turning on a solenoid 45. A switching arm 46 is rotatably fixed by a pin to a tip of a plunger of the solenoid 45. The rotating shaft 19 of the rotary roller 13 is then held within a top of a triangular ring 47 so that the rotary roller 13 can be moved along either a first guide path 48 or a second guide path 49 within a V zone defined by the triangular ring 47.

When turning on the solenoid 45 in a state (that the first coin outlet 10 is opened) as shown in FIG. 13, the plunger is drawn to rotate a switching arm 46 in the clockwise direction. The rotary roller 13 held within the second guide path 49 is thus guided via a coupling path 50 to the first guide path 48. When turning off an electric current, the rotary roller 13 is guided from the right to the left, thus completing the ejecting direction's transfer.

Sixth embodiment

Figure 14:
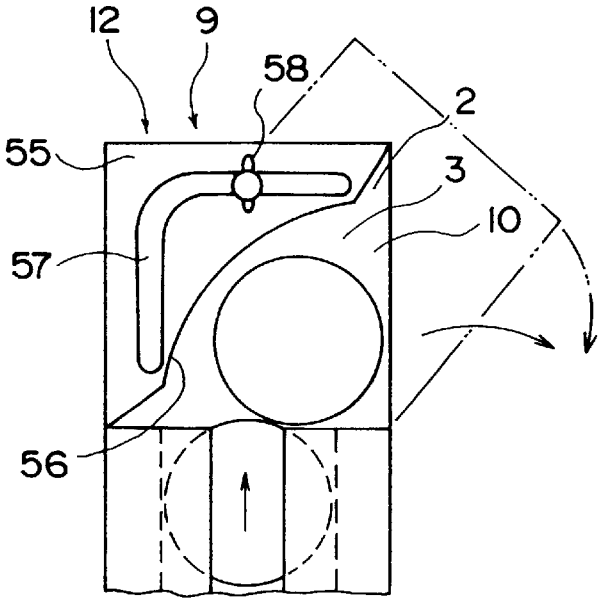
FIG. 14 is a partially enlarged view of a coin conveying device according to a sixth embodiment.
Figure 15:
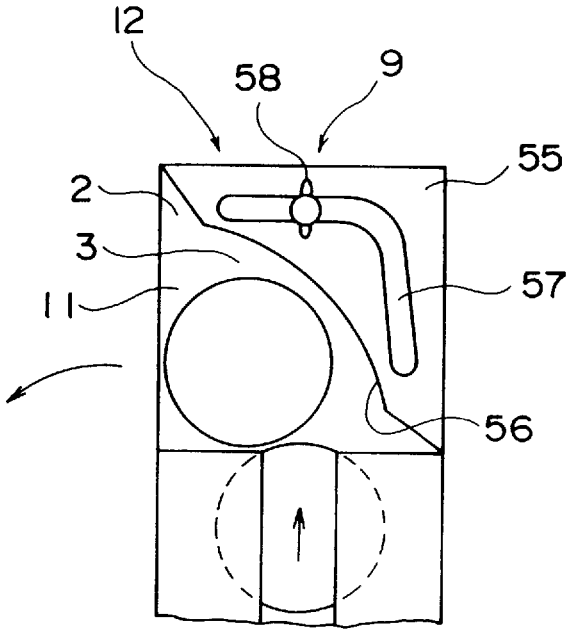
FIG. 15 is a partially enlarged view of the coin conveying device according to the sixth embodiment.

Referring next to FIGS. 14 and 15, the sixth embodiment will be described. FIGS. 14 and 15 each show a state that the cover plate of the upper end portion 9 is removed to expose the coin passage 3. The outlet switching means according to this embodiment is operated by changing the mounting position of a guide plate 55 provided in the upper end portion 9.

That is, the guide plate 55 can be arranged on the right side of the upper end portion 9 when the coin is to be ejected from the first coin outlet 10 (FIG. 14) and on the left side of the upper end portion 9 when the coin is to be ejected from the second coin outlet 11.

The guide plate 55 is formed into an equilateral triangle so as to show symmetry between the right and left halves, part of the guide plate 55 corresponding to a bottom side 56 describing a circular arc along which the coin is guided to the outlet. Further, a guide hole 57 is provided through the guide plate 55 in a direction of its thickness to be used as outlet switching means. The guide hole 57 substantially describes an L-shape showing symmetry between the right and left halves and extending along oblique sides of the guide plate 55 so that a fixed screw 58 can be held therein. The fixed screw 58 projects from the back side of the passage plate 2 (from the back side of the drawing paper) toward the face side so that the guide plate 55 can be fixed with a fly nut to the passage plate 2 as the fixed screw 57 penetrates the guide hole 57.

The procedure for switching the coin outlet will be described hereinbelow. The coin is ejected from the first coin outlet 10 in the state of FIG. 14 and from the second coin outlet 11 in the state of FIG. 15. In order to switch the coin outlet, the fixed screw 58 is loosened in the state of FIG. 14 so that the guide plate 55 can be rotated in the clockwise direction while moving the fixed screw in the right direction restrictedly along the guide hole 57. When changing to the state of FIG. 15, the fixed screw is fastened so that the guide plate 55 can be fixed to the passage plate 2. For this, the guide plate 55 reaches the goal shown in FIG. 15, in which the first coin outlet 10 is closed and the second coin outlet 11 is opened, thus completing the change of the coin outlet.

While the above embodiments have each described a coin conveying device for ejecting coins from the right or left side, such an ejecting direction is not limited thereto. The coin conveying device may eject coins from the front and back sides along a direction of its thickness. Further, different coin outlets may be provided in two positions on either of the right and left sides, or on either of the front and back sides, and the outlet switching means may be provided between the coin outlets.

In the embodiments, the first guide path 14, the second guide path 15 and the coupling path 22 are each formed into a groove penetrating the passage plate 2, but any other forms can be adopted without departing from the spirit or scope of the present invention. For example, those paths can be guide rails provided on the passage plate 2.

INDUSTRIAL APPLICABILITY

The coin conveying device according to the present invention can be manufactured as a single part without no need to manufacture different parts such as right side and left side parts individually for two-way ejection, thereby obtaining a cost-efficient and easily assembled device which can easily change its coin ejecting direction even after delivery.

What is claimed is:

1. A coin conveying device having a passage plate and a coin passage formed in a first direction along said passage plate, which conveys coins fed by a coin feeding means into a inlet of said coin passage and ejects them in a second direction from a first coin outlet provided in coin passage above the coin inlet, wherein a second coin outlet is disposed nearby said first coin outlet and is provided in said coin passage, and ejects coins in a third direction, and outlet switching means is provided between said first and second coin outlets, whereby the coins are guided to either said first coin outlet or said second coin outlet owing to said outlet switching means, wherein said first, second and third directions differ and said coin election is by force transmitted by succeeding coins.

2. The cover conveying device of claim 1 wherein said first direction is substantially vertical.

3. A coin conveying device having a passage plate and a coin passage formed along said passage plate, which conveys coins fed by a coin feeding means into a coin inlet of said coin passage and ejects them from a first coin outlet provided above the coin inlet, wherein a second coin outlet nearby said first coin outlet is provided in said coin passage, and outlet switch means is provided between said first and second coin outlets, whereby the coins are guided to either said first coin outlet or said second coin outlet owing to said outlet switching means wherein coin guide means is provided so that said outlet switching means can be attached to and removed from said passage plate, and the coins are guided to said first coin outlet when said coin guide means is held in a second holding position on said passage plate and to said second coin outlet when it is held in a first holding position.

4. The coin conveying device of claim 3, wherein a coupling path is provided on said passage plate for communicating the first holding position with the second holding position, whereby said coin guide means can be moved between the first holding position and the second holding position just as it was attached to said passage plate.

5. The coin conveying device of claim 3, wherein the first holding position is provided in a first guide path, the second holding position is provided in a second guide path, and said coin guide means is moved one of from the second holding position along said second guide path due to feeding of the coins so that said second coin outlet can be closed, and the first holding position along said first guide path due to feeding of the coins so that said first coin outlet can be closed.

6. The coin conveying device of claim 5, wherein said coin guide means moved due to feeding of the coins returns to the original position by its own weight after the coins pass through.

7. The coin conveying device of claim 5, wherein recovery means is provided for returning said coin guide means to the original position by compulsion.

8. The coin conveying device of claim 7, wherein said recovery means comprises one of a weight provided in said coin guide means and a spring for making said coin guide means elastic.

9. The coin conveying device of claim 3, wherein the first holding position is provided in a first guide path, the second holding position is provided in a second guide path, said coin guide means is moved one of from the second holding position along said second guide path due to feeding of the coins so that said second coin outlet can be closed, and the first holding position along said first guide path due to feeding of the coins so that said first coin outlet can be closed, and recovery means is provided for returning said coin guide means to the original position by compulsion after the coins pass through, whereby the coins are compulsively ejected from one of said coin outlets when said coin guide means is returned to the original position under the action of said recovery means.

10. The coin conveying device of claim 9, wherein said recovery means comprises one of a weight and a spring.

11. The coin conveying device of claim 3, wherein said coin guide means comprises a rotary roller in contact with the edge of the coin and a roller shaft supporting the rotary roller, and said roller shaft is guided along said first guide path or said second guide path.

12. The coin conveying device of claim 11, wherein an inclined plane is provided around said rotary roller for pushing the coin against said passage plate when contacting with the edge of said coin.

13. The coin conveying device of claim 4, wherein the passage constituted of said first guide path, said second guide path and said coupling path substantially comprises at least one of a;

reverse V-shape, reverse U-shape, H-shape and downward channel shape.

14. The coin conveying device of claim 4, wherein the first holding position is provided in a first guide path, the second holding position is provided in a second guide path, and said coin guide means is moved from one of the second holding position along said second guide path due to feeding of the coins so that said second coin outlet can be closed, and from the first holding position along said first guide path due to feeding of the coins so that said first coin outlet can be closed.

15. The coin conveying device of claim 14, wherein said coin guide means moved due to feeding of the coins returns to the original position by its own weight after the coins pass through.

16. The coin conveying device of claim 14, wherein recovery means is provided for returning said coin guide means to the original position by compulsion.

17. The coin conveying device of claim 16, wherein said recovery means is a weight provided in said coin guide means or a spring for making said coin guide means elastic.

18. The coin conveying device of claim 4, wherein the first holding position is provided in a first guide path, the second holding position is provided in a second guide path, said coin guide means is moved either from the second holding position along said second guide path due to feeding of the coins so that said second coin outlet can be closed, or from the first holding position along said first guide path due to feeding of the coins so that said first coin outlet can be closed, and recovery means is provided for returning said coin guide means to the original position by compulsion after the coins pass through, whereby the coins are compulsively ejected from one of said coin outlets when said guide means is returned to the original position under the action of said recovery means.

19. The coin conveying device of claim 18, wherein said recovery means comprises one of a weight and a spring.

20. The coin conveying device of claim 9, wherein said coin guide means comprises a rotary roller in contact with the edge of the coin and a roller shaft supporting the rotary roller, and said roller shaft is guided along one of said first guide path and said second guide path.

21. The coin conveying device of claim 9, wherein the passage constituted of said first guide path, said second guide path and said coupling path substantially comprises at least one of a reverse V-shape, reverse U-shape, H-shape and downward channel shape.

* * * * *